US010527247B2

(12) United States Patent
Kowalski et al.

(10) Patent No.: US 10,527,247 B2
(45) Date of Patent: Jan. 7, 2020

(54) EFFICIENT WHITE LAMP FOR VEHICLE HEADLIGHT

(71) Applicant: LUMILEDS HOLDING B.V., Schiphol (NL)

(72) Inventors: Jacek Kowalski, Łódź (PL); Jean-Sebastien Straetmans, Aachen (DE); Lukas Kuepper, Aachen (DE); Maciej Dawid Pakulski, Aachen (DE)

(73) Assignee: LUMILEDS HOLDING B.V., Schiphol (NL)

( * ) Notice: Subject to any disclaimer, the term of this patent is extended or adjusted under 35 U.S.C. 154(b) by 0 days.

(21) Appl. No.: 16/385,722

(22) Filed: Apr. 16, 2019

(65) Prior Publication Data

US 2019/0316750 A1 Oct. 17, 2019

(30) Foreign Application Priority Data

Apr. 16, 2018 (EP) ..... 18167544

(51) Int. Cl.

| | |
|---|---|
| ***F21S 41/162*** | (2018.01) |
| ***F21V 3/00*** | (2015.01) |
| ***F21S 41/12*** | (2018.01) |
| ***H01J 9/20*** | (2006.01) |

(52) U.S. Cl.

CPC ..... *F21S 41/162* (2018.01); *F21S 41/12* (2018.01); *F21V 3/00* (2013.01); *H01J 9/205* (2013.01)

(58) Field of Classification Search

CPC ... F21S 41/162; F21V 3/00; H01J 9/20; H01J 61/35; H01J 61/40; H01J 9/205; H01J 9/00; H01K 1/32; H01K 9/08

See application file for complete search history.

(56) References Cited

U.S. PATENT DOCUMENTS

| | | | |
|---|---|---|---|
| 6,508,573 | B1 | 1/2003 | Yamazaki |
| 2018/0019373 | A1 | 1/2018 | Lehnhardt et al. |

FOREIGN PATENT DOCUMENTS

| | | | |
|---|---|---|---|
| DE | 102008033019 | A1 | 1/2010 |

*Primary Examiner* — Joseph L Williams
*Assistant Examiner* — Jose M Diaz
(74) *Attorney, Agent, or Firm* — Volpe and Koenig, P.C.

(57) ABSTRACT

An incandescent lamp for a vehicle headlight comprising a transparent vessel that encloses at least one filament and the vessel is at least partly covered with a coating. The coating comprises at least one pigment, which is arranged such that light emitted by the at least one filament and traversing the coating is transformed to transformed light. The transformed light is characterized by a chromaticity according to the CIE 1931 xy-chromaticity with y being in between the Planckian locus and $y=0.5*x+0.205$ and $0.36<x<0.42$, and wherein the at least one pigment comprises a mixture of Co—Al oxide and Co—Al—Cr oxide, the mixture being characterized by a ratio of a concentration in mass percentage Cm(Co—Al oxide) of Co—Al oxide and a concentration in mass percentage Cm(Co—Al—Cr oxide) of Co—Al—Cr oxide in the coating of $90/10 \geq Cm(Co—Al\ oxide)/Cm(Co—Al—Cr\ oxide) \geq 30/70$.

10 Claims, 4 Drawing Sheets

EFFICIENT WHITE LAMP FOR VEHICLE HEADLIGHT

FIELD OF INVENTION

The invention relates to an incandescent lamp for a vehicle headlight, especially an automotive headlight, emitting white light with high efficiency. The invention further relates to a vehicle headlight comprising such an incandescent lamp.

BACKGROUND

Incandescent lamps for automotive headlights like H1, H4, H7, H11 and similar halogen lamps are usually characterized by white light having a yellowish tint. Previous approaches to improve light quality to a more pure white were at the price of a reduced efficiency.

Examples of previous approaches are: DE102008033019A1 proposing an interference and/or absorption coating transmitting close to the maximum of the eye sensitivity, thus providing high color temperatures, but being silent on the material composition of the coating and its transmission efficiency; and U.S. Pat. No. 6,508,573B1 proposing various red absorbing metal oxides for a film on an incandescent lamp's glass bulb providing a color temperature of 4000 K for the lamp.

SUMMARY

It is an object of the present invention to provide an incandescent lamp for a vehicle headlight with improved light quality.

According to a first aspect of the invention an incandescent lamp for a vehicle headlight, especially an automotive headlight is provided. The incandescent lamp comprises a transparent vessel. The vessel encloses at least one filament. The vessel is at least partly covered with a coating. The coating comprises at least one pigment. The at least one pigment is arranged such that light emitted by the at least one filament and traversing the coating is transformed to transformed light. The transformed light is characterized by a chromaticity according to the CIE 1931 xy-chromaticity. The y value of the chromaticity is arranged between the Planckian locus and $y=0.5*x+0.205$, more preferably $y=0.5*x+0.202$ and most preferably $y=0.5*x+0.200$ for the x value of the chromaticity being $0.36<x<0.42$, more preferably $0.37<x<0.41$, most preferably $0.375<x<0.407$.

The at least one pigment in the coating may enable raising the color temperature by more than 10% in comparison to standard coatings which enable only color temperatures between 3900 K-4100 K. The improvement of the color temperature has been proven for the popular H1, H4, H7, and H11 lamps by real application measurements from the perspective of an observer on the street looking at the reflector of the vehicle headlight (see FIG. 5). The incandescent lamp with the coating is therefore arranged to provide whiter light in comparison to incandescent lamps with standard coatings that emit light appearing yellowish as described above. The transformed light with increased y-value in comparison to prior art incandescent lamps appears fresher because of a better overlap between the V(lambda) curve of the human eye perception with the emission spectrum of the lamp. The better overlap may, for example, improve the night vision of a driver of a vehicle with a headlight comprising one or more incandescent lamps as described above and may therefore reduce tiring of the driver. Furthermore, the whiter light improves visibility of retroreflective surfaces of road infrastructure and retroreflective safety elements used by other traffic participants.

The at least one pigment comprises cobalt and chromium. The coating may comprise one pigment or a mixture of two, three or more pigments.

The at least one pigment comprises a mixture of Co—Al oxide (cobalt aluminate) and Co—Al—Cr oxide (cobalt chromium aluminate). The mixture is characterized by a ratio of a concentration in mass percentage Cm(Co—Al oxide) of Co—Al oxide and a concentration in mass percentage Cm(Co—Al—Cr oxide) of Co—Al—Cr oxide in the coating given by Cm(Co—Al oxide)/Cm(Co—Al—Cr oxide), wherein such ratio Cm(Co—Al oxide)/Cm(Co—Al—Cr oxide) is between 90/10 and 30/70, more preferably between 80/20 and 40/60, most preferably between 75/25 and 45/55.

The coating may further comprise at least one material selected out of the group Ti—Sb—Ni or Bi—V-Ox or chromium oxides of different stoichiometry.

The coating may be characterized by a layer thickness perpendicular to a surface of the vessel between 200 nm and 1000 nm. The coating may comprise silicon oxide. The pigment or pigment mixture may be provided on the vessel, being e.g. made of glass, of the incandescent lamp by means of a liquid silicon component, which enables application by various methods such as clipping, spraying, tamponing or printing. The mixture comprising a pigment or pigments as a part of a liquid solution must be prepared in a way that unnecessary absorption of light during operation of the incandescent lamp is avoided.

A maximum particle size of particles comprised by the at least one pigment may be smaller than 200 nm, preferably smaller than 150 nm and most preferably smaller than 120 nm. Using small particles in combination with a liquid solution as described above may help to avoid agglomeration of pigment particles that could negatively affect absorption of light. The coating may be applied as gradient coating, which may strengthen the visual effect in the respective application. The terminology "gradient coating" means that in a pre-defined direction the thickness of the coating, and, therewith, also the optical absorption performed by the coating, changes. The coating may alternatively be applied as a homogeneous coating (e.g. as a stripe around the vessel).

The y value of the chromaticity may preferably be arranged slightly above the Planckian locus. The y value may be preferably bigger than $0.6*x+0.15$.

The coating may be used for the following types of incandescent lamps, which are used in automotive applications: H1, HB2, H4, H7, H3, H8, H11, H11B, HIR2, 9004/HB1, 9005/HB3, 9006/HB4, 9007/HB5, 9008/1113, 9005XS, 9006XS. The incandescent lamp may especially be an H1, H4, H7, or H11 halogen lamp.

The incandescent lamp may be an H1 or 114 halogen lamp. The ratio Cm(Co—Al oxide)/Cm(Co—Al—Cr oxide) may in this embodiment be between 75/25 and 65/35, preferably between 73/27 and 67/33, and most preferably between 71/29 and 69/31. The ratio Cm(Co—Al oxide)/Cm(Co—Al—Cr oxide) may be 70/30.

The incandescent lamp may alternatively be an H7 or H11 halogen lamp. The ratio Cm(Co—Al oxide)/Cm(Co—Al—Cr oxide) may in this embodiment be between 55/45 and 45/55, preferably between 53/47 and 47/53, and most preferably between 51/49 and 49/51. The ratio Cm(Co—Al oxide)/Cm(Co—Al—Cr oxide) may be 50/50.

According to a further aspect a vehicle headlight and especially an automotive headlight is provided. The vehicle headlight comprises at least one incandescent lamp according to any embodiment described above.

It shall be understood that a preferred embodiment of the invention can also be any combination of the dependent claims with the respective independent claim.

Further advantageous embodiments are defined below.

BRIEF DESCRIPTION OF THE DRAWINGS

These and other aspects of the invention will be apparent from and elucidated with reference to the embodiments described hereinafter.

The invention will now be described, by way of example, based on embodiments with reference to the accompanying drawings.

In the drawings:

FIG. 1 shows the color area obtainable with an inventive incandescent lamp.

FIG. 2 shows a principal sketch of a first inventive incandescent lamp and a corresponding absorption diagram.

FIG. 3 shows a principal sketch of a coating.

FIG. 4 shows a principal sketch of a second inventive incandescent lamp and corresponding absorption diagram.

FIG. 5 shows a principal sketch of an inventive vehicle headlight.

In the Figures, like numbers refer to like objects throughout. Objects in the Figures are not necessarily drawn to scale.

DETAILED DESCRIPTION OF THE PREFERRED EMBODIMENTS

Various embodiments of the invention will now be described by means of the Figures.

Figure 1:
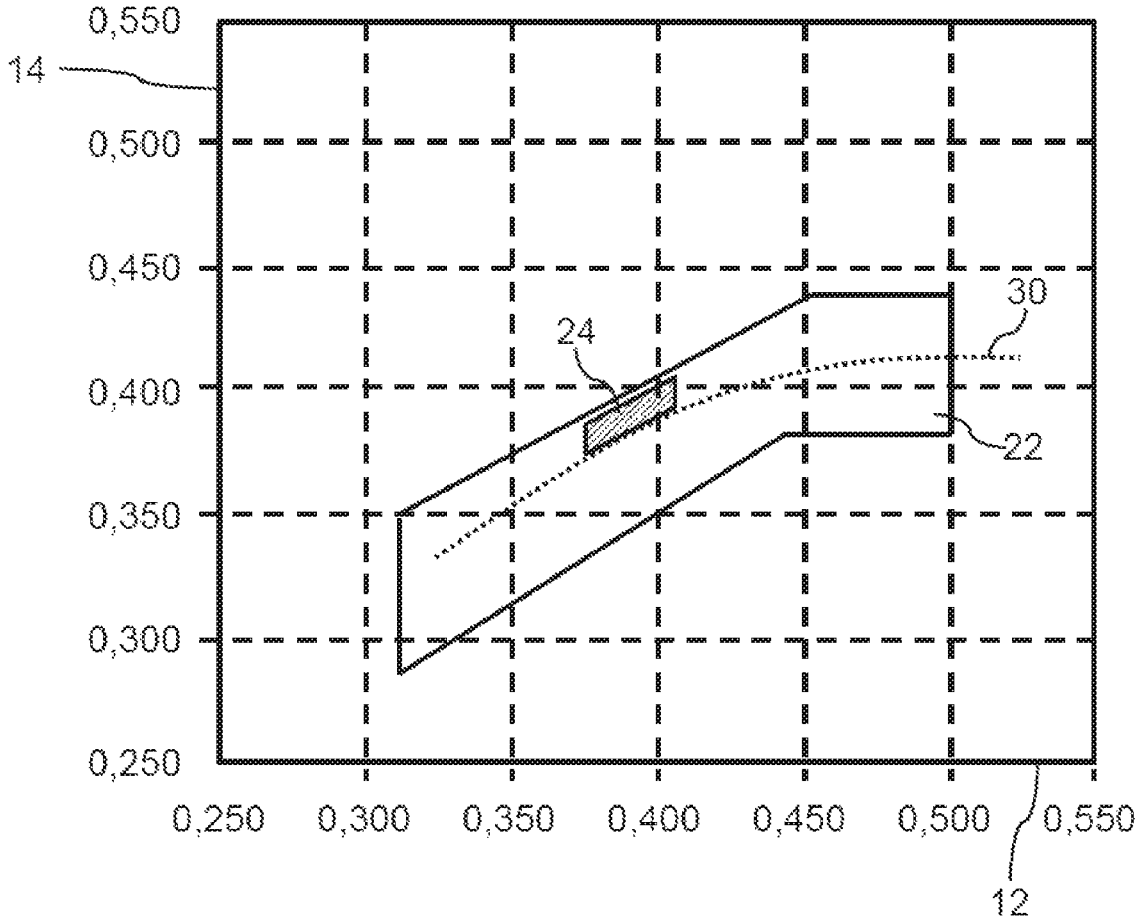

FIG. 1 shows the color area obtainable with the coating of an inventive incandescent lamp. The x-axis 12 corresponds to the x-value of the CIE 1931 xy-chromaticity and the y-axis corresponds to the y-value of the CIE 1931 xy-chromaticity. The dotted line shows the Planckian locus 30. Area 22 shows the area characterizing white light emitted by an incandescent lamp that would be in accordance with the regulation ECE R37 (Agreement concerning the adoption of uniform technical prescriptions for wheeled vehicles, equipment and parts which can be fitted and/or be used on wheeled vehicles and the conditions for reciprocal recognition of approvals granted on the basis of these prescriptions. Regulation No. 37: Uniform provisions concerning the approval of filament lamps for use in approved lamp units of power-driven vehicles and of their trailers). The smaller shaded area 24 above the Planckian locus 30 characterizes transformed light 55 being emitted by an inventive incandescent lamp. Chromium and cobalt-based pigments which are comprised by a coating provided on a vessel of the incandescent lamp are used to shift the characteristic of the light emitted by the filament of the incandescent lamp above the Planckian locus 30. The chromaticity of the transformed light 55 is characterized by y being in between the Planckian locus and $y=0.5*x+0.205$, more preferably $y=0.5*x+0.202$ and most preferably $y=0.5*x+0.200$ for $0.36<x<0.42$, more preferably $0.37<x<0.41$, most preferably $0.375<x<0.407$. The shaded area 24 shows the most preferred characteristic of the transformed light 55.

Figure 2:
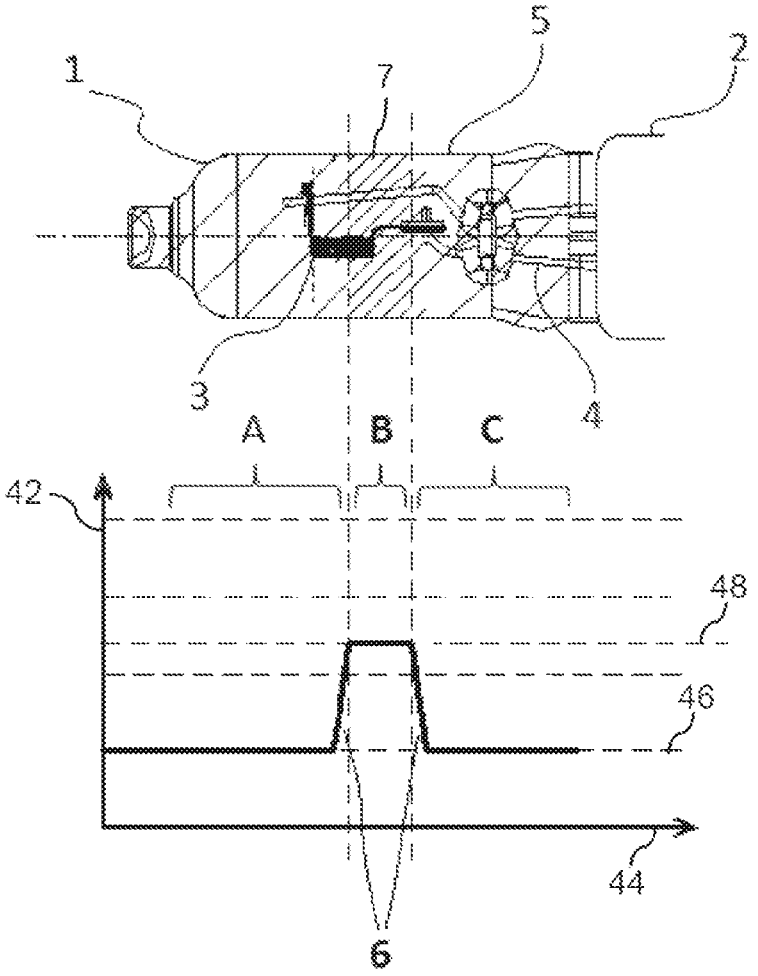

FIG. 2 shows a principal sketch of a first inventive incandescent lamp and a corresponding absorption diagram. The absorption 42 refers to the whole visual spectrum. The incandescent lamp comprises a lamp base 2 and a vessel 5, which is arranged on the lamp base 2. The vessel 5 encloses a lamp volume, which is filled with a protective gas. A filament 3 is arranged in the lamp volume and electrically connected by means of corresponding electrical conductors 4. The first inventive incandescent lamp comprises a top coating 1 and a stripe like coating 7 comprising a mixture of pigments as described above and below. The coating 7 is characterized by a maximum absorption 48 which is shown in section B in the lower part of FIG. 2. The ordinate shows the absorption 42 and the abscissa the longitudinal extension 44 of the vessel 5. The coating 7 is surrounded by sections A and C of the vessel 5 with lower absorption (minimum absorption 46). There is an intermediate gradient coating 6 which provides the transition from the low absorption sections A and C to the high absorption section B of the coating 7. The coating 7 is characterized by a thickness of 600 nm and comprises at least one pigment. The at least one pigment comprises first particles 8 (Co—Al oxide particles) and second particles 9 (Co—Al—Cr oxide particles). The first particles 8 and the second particles 9 are mixed in a ratio of a concentration in mass percentage Cm(Co—Al oxide) of Co—Al oxide and a concentration in mass percentage Cm(Co—Al—Cr oxide) of Co—Al—Cr oxide given by Cm(Co—Al oxide)/Cm(Co—Al—Cr oxide)=50/50.

Figure 3:
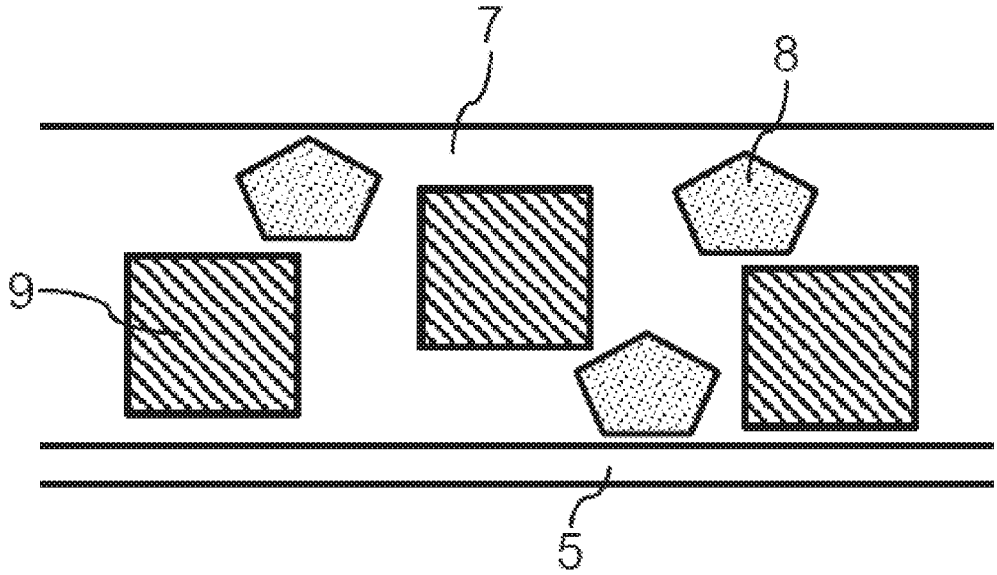

FIG. 3 shows a principal sketch of a coating 7 being coated on a glass vessel 5 and comprising the at least one pigment comprising, for example, first particles 8 and second particles 9 as discussed with respect to FIG. 2. The coating 7 is comprised by a H4 halogen lamp. The coating 7 is characterized by a thickness of 300 nm. The pigment comprises first Co—Al oxide particles 8 with a maximum size of 130 nm and second Co—Al—Cr oxide particles 9 with a maximum size of 200 nm. The first particles 8 and the second particles 9 are mixed in a ratio of a concentration in mass percentage Cm(Co—Al oxide) of Co—Al oxide and a concentration in mass percentage Cm(Co—Al—Cr oxide) of Co—Al—Cr oxide given by Cm(Co—Al oxide)/Cm (Co—Al—Cr oxide)=70/30.

Figure 4:
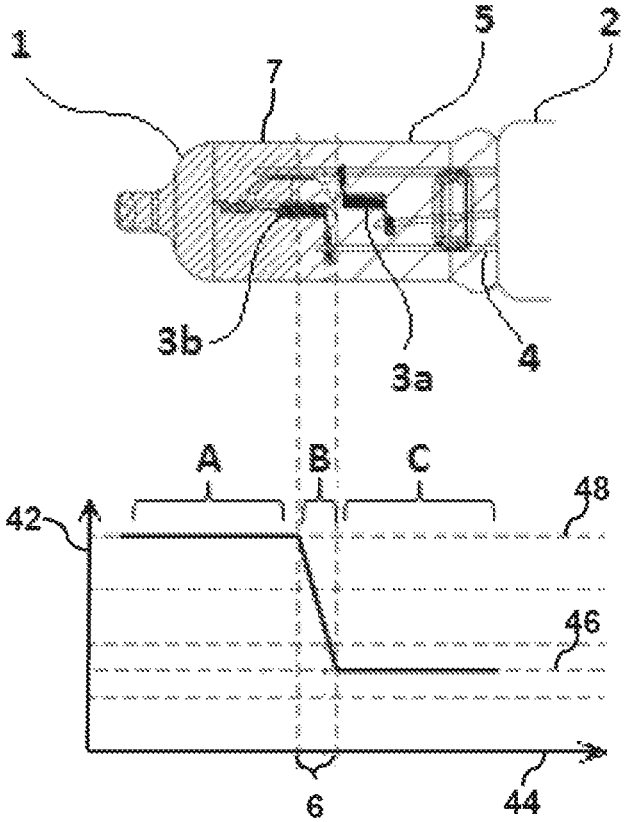

FIG. 4 shows a principal sketch of a second inventive incandescent lamp and a corresponding absorption diagram. The incandescent lamp comprises again a lamp base 2 and a vessel 5, which is arranged on the lamp base 2. The vessel 5 encloses a lamp volume, which is filled with a protective gas. A first filament 3*a* and a second filament 3*b* are arranged in the lamp volume and electrically connected by means of corresponding electrical conductors 4. The second incandescent lamp comprises a top coating 1 and a coating 7 that borders the top coating 1. The coating 7 is characterized by a maximum absorption 48 which is shown in the lower part of FIG. 4 in section A. The ordinate shows the absorption 42 and the abscissa the longitudinal extension 44 of the vessel 5. The coating 7, on its other side, borders an intermediate gradient coating 6, which provides the transition in section B from the low absorption section C to the high absorption section A. The coating 7 is characterized by a thickness of 400 nm and comprises at least one pigment comprising first particles 8 and second particles 9. The first particles 8 comprise Co—Al oxide and the second particles 9 comprises Co—Al—Cr oxide. The first particles 8 and the second particles 9 are mixed in a ratio of a concentration in mass percentage Cm(Co—Al oxide) of Co—Al oxide and a concentration in mass percentage Cm(Co—Al—Cr oxide) of Co—Al—Cr oxide given by Cm(Co—Al oxide)/Cm (Co—Al—Cr oxide)=60/40.

Figure 5:
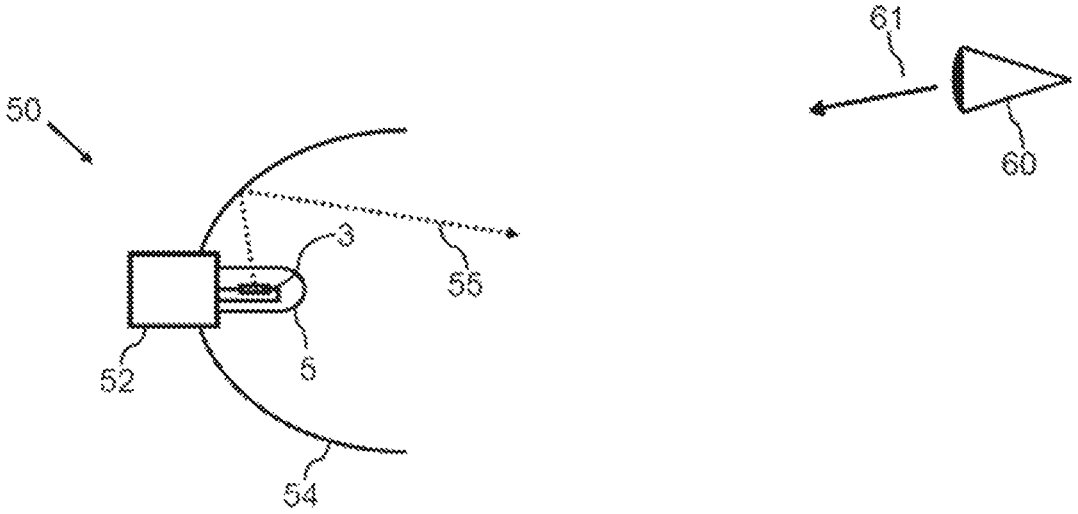

FIG. 5 shows a principal sketch of an inventive automotive headlight 50. The automotive headlight 50 comprises a lamp socket 52, a reflector 54 and an inventive incandescent lamp. The incandescent lamp comprises one filament 3 and a vessel 5. The vessel 5 is coated with a coating (not shown) comprising a pigment comprising cobalt and chromium. The coating is characterized by a thickness of 500 nm and the particles of the pigments are smaller than 120 nm. An observer 60 and a corresponding viewing direction 61 indicate the perspective of the application measurements made to prove the improvement of the light quality described above.

While the invention has been illustrated and described in detail in the drawings and the foregoing description, such illustration and description are to be considered illustrative or exemplary and not restrictive.

From reading the present disclosure, other modifications will be apparent to persons skilled in the art. Such modifications may involve other features which are already known in the art and which may be used instead of or in addition to features described herein.

Variations to the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

REFERENCE SIGNS

1 top coating
2 lamp base
3 filament
3*a* first filament
3*b* second filament
4 electrical conductors
5 vessel
6 gradient coating
7 coating
8 first particles
9 second particles
12 x axis CIE 1931 xy-chromaticity
14 y axis CIE 1931 xy-chromaticity
22 white area according to ECE R37
24 chromaticity area of transformed light
30 Planckian locus
42 absorption
44 longitudinal extension of lamp vessel
46 minimum absorption
48 maximum absorption
50 automotive headlight
52 lamp socket
54 reflector
55 transformed light
60 observer
61 viewing direction
A, B, C absorption sections along longitudinal extension of lamp vessel

What is claimed is:

1. An incandescent lamp comprising:
a transparent vessel,
wherein the transparent vessel encloses at least one filament,
wherein the transparent vessel is at least partly covered with a coating,
wherein the coating comprises at least one pigment, wherein the at least one pigment is arranged such that light emitted by the at least one filament and traversing the coating is transformed to transformed light,
wherein the transformed light is characterized by a chromaticity according to the CIE 1931 xy-chromaticity with y being in between the Planckian locus and $y=0.5*x+0.205$ and $0.36<x<0.42$, and
wherein the at least one pigment comprises a mixture of Co—Al oxide and Co—Al—Cr oxide, the mixture being characterized by a ratio of a concentration in mass percentage Cm(Co—Al oxide) of Co—Al oxide and a concentration in mass percentage Cm(Co—Al—Cr oxide) of Co—Al—Cr oxide in the coating of $90/10 \geq Cm(Co—Al\ oxide)/Cm(Co—Al—Cr\ oxide) \geq 30/70$.

2. The incandescent lamp according to claim 1, wherein the ratio Cm(Co—Al oxide)/Cm(Co—Al—Cr oxide) is between 80/20 and 40/60.

3. The incandescent lamp according to claim 2, wherein the ratio Cm(Co—Al oxide)/Cm(Co—Al—Cr oxide) is between 75/25 and 45/55.

4. The incandescent lamp according to claim 1, wherein the coating is characterized by a layer thickness perpendicular to a surface of the vessel between 200 nm and 1000 nm, and wherein the coating comprises silicon oxide.

5. The incandescent lamp according to claim 1, wherein a maximum particle size of particles comprised by the at least one pigment is smaller than 200 nm.

6. The incandescent lamp according to claim 1 wherein $y>0.6*x+0.15$.

7. The incandescent lamp according to claim 1, wherein the incandescent lamp is at least one of H1, H4, H7, and H11 halogen lamp.

8. The incandescent lamp according to claim 7, wherein the incandescent lamp is at least one of H1 and H4 halogen lamp, and wherein the ratio Cm(Co—Al oxide)/Cm(Co—Al—Cr oxide) is between 75/25 and 65/35.

9. The incandescent lamp according to claim 7, wherein the incandescent lamp is at least one of H7 and H11 halogen lamp, and wherein the ratio Cm(Co—Al oxide)/Cm(Co—Al—Cr oxide) is between 55/45 and 45/55.

10. A vehicle headlight comprising:
an incandescent lamp including a transparent vessel,
wherein the transparent vessel encloses at least one filament,
wherein the transparent vessel is at least partly covered with a coating,
wherein the coating comprises at least one pigment, wherein the at least one pigment is arranged such that light emitted by the at least one filament and traversing the coating is transformed to transformed light,
wherein the transformed light is characterized by a chromaticity according to the CIE 1931 xy-chromaticity with y being in between the Planckian locus and $y=0.5*x+0.205$ and $0.36<x<0.42$, and
wherein the at least one pigment comprises a mixture of Co—Al oxide and Co—Al—Cr oxide, the mixture being characterized by a ratio of a concentration in mass percentage Cm(Co—Al oxide) of Co—Al oxide and a concentration in mass percentage Cm(Co—Al—Cr oxide) of Co—Al—Cr oxide in the coating of 90/10≥Cm(Co—Al oxide)/Cm(Co—Al—Cr oxide)≥30/70.

* * * * *